United States Patent [19]

Miller et al.

[11] Patent Number: 4,785,950

[45] Date of Patent: Nov. 22, 1988

[54] PLASTIC BOTTLE BASE REINFORCEMENT

[75] Inventors: Bryan H. Miller, Nashua; Lawrence G. Jerry, Merrimack, both of N.H.

[73] Assignee: Continental PET Technologies, Inc., Norwalk, Conn.

[21] Appl. No.: 838,816

[22] Filed: Mar. 12, 1986

[51] Int. Cl.[4] ..... B65D 1/02; B65D 1/42; B65D 23/00

[52] U.S. Cl. ..... 215/1 C; 220/70; 220/72

[58] Field of Search ..... 215/1 C; 220/66, 70, 220/72; 264/219, 509, 532

[56] References Cited

U.S. PATENT DOCUMENTS

| | | | |
|---|---|---|---|
| 3,598,270 | 8/1971 | Adomaities et al. | 215/1 C |
| 3,825,141 | 7/1974 | Campagna | 215/1 C |
| 4,024,975 | 5/1977 | Uhlig | 215/1 C |
| 4,134,510 | 1/1979 | Chang | 215/1 C |
| 4,254,882 | 3/1981 | Yoshino | 220/70 X |
| 4,359,165 | 11/1982 | Jakobsen | 215/1 C |
| 4,375,442 | 3/1983 | Ota et al. | 215/1 C |
| 4,481,163 | 11/1984 | Ota et al. | 215/1 C X |

*Primary Examiner*—Sue A. Weaver

*Attorney, Agent, or Firm*—Charles E. Brown; Paul Shapiro; Charles A. Brown

[57] ABSTRACT

This relates to the strengthening of the base of a blow molded plastic bottle and like container wherein the container base is of the type having generally hemispherical portions alternating circumferentially with projecting feet defining portions. It has been found that by roughening the surface of the base, particularly the lower central portion thereof, the base is greatly strengthened. The base is formed by blow molding in a blow mold base portion which has been roughened by shot peening.

10 Claims, 1 Drawing Sheet

FIG.1
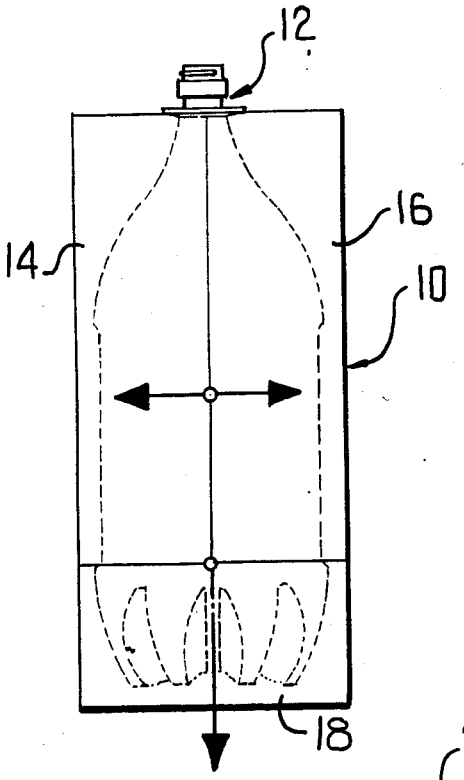
FIG.3
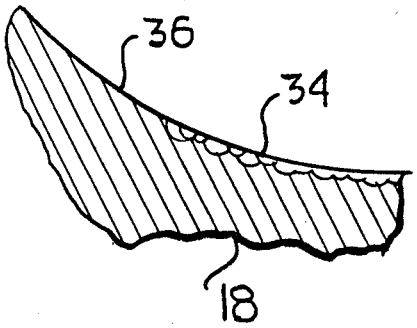
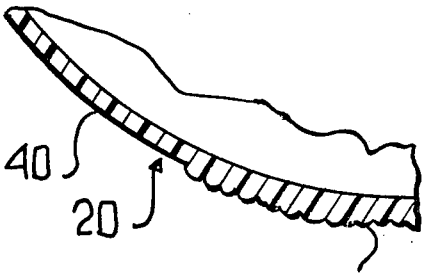
FIG.5
FIG.2
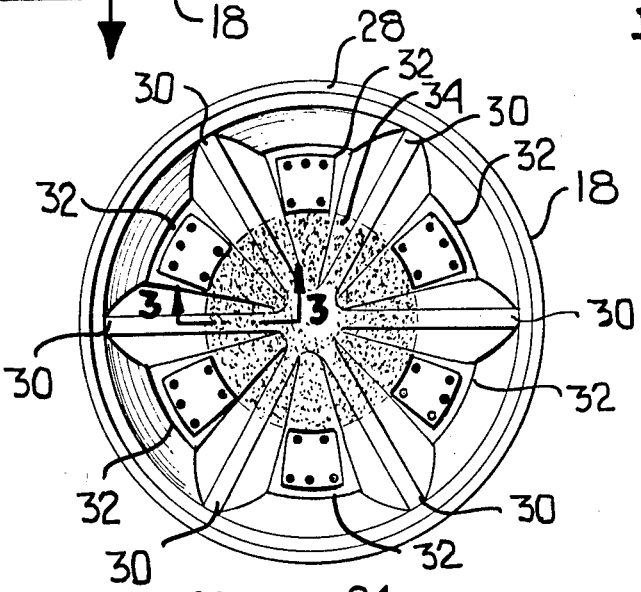
FIG.4
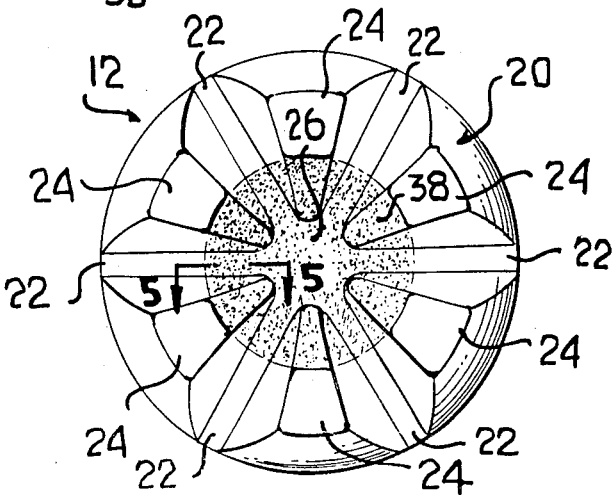

PLASTIC BOTTLE BASE REINFORCEMENT

This invention relates in general to new and useful improvements in the formation of blow molded plastic bottles particularly adapted for containing liquids under pressure, and more particularly to the strengthening of the base of such bottle.

This invention particularly relates to one-piece plastic bottles having a base configuration such as that shown in U.S. Pat. No. 3,598,270 wherein the base is formed with generally hemispherical portions disposed in circumferential alternating relation with projecting feet defining portions. While this bottle has been in commercial use for some time, there has always been a problem associated with the bottle when utilized as a pressurized container for carbonated beverages and the like from an environmental stress cracking standpoint. Due to the internal pressure and the configuration of the base, it is always a requirement to keep one's process of making the containers in control to minimize stress cracking phenomena.

In order to fully understand the deficiency of bottles of the configuration shown generally in U.S. Pat. No. 3,598,270, this can be best considered by looking at the base configuration. It will be seen that there are a number of separate feet (normally six) that protrude out from the center of the base. When a bottle is pressurized to approximately 60 psi (4.0 volumes of carbon dioxide at 72° F.) there is a force exerted on the base of the bottle uniformly. Under these circumstances, the inner surface of the base or inner surface of the bottle is under compression while the outside surfaces have great forces acting upon them. It has been found that the bottle base fails with the failure initiating on the outside surface.

The surface energy on the outside surface of the bottle base is so great that a small flaw or any foreign substances incorporated in the material of the base can cause failure with time. Outside substances such as lubricants or soap-based products that attack polyethylene terephthalate (PET) will also cause failure with time.

In accordance with this invention, there has been found that if the surface energy on the outside surface of the base could be minimized, this would greatly reduce base failure. Most particularly, it has been found that the surface energy on the outside surface of the base could be minimized by making the surface rough instead of smooth. This allows the surface energy to be dispersed over a greater area and also there is more flex because of the irregularity.

In accordance with this invention, there is provided a customary mold base which has been modified to have an irregular or rough textured surface which will be molded into the exterior surface of the bottle base to provide the rough textured surface thereby restricting failure due to flaws, etc.

With the above and other objects in view that will hereinafter appear, the nature of the invention will be more clearly understood by reference to the following detailed description, the appended claims, and the several views illustrated in the accompanying drawing.

FIG. 1 is an elevational view of a typical blow mold in accordance with this invention in which there is illustrated a newly blown bottle formed in accordance with this invention.

FIG. 2 is a top plan view of the base of the blow mold of FIG. 1 and shows the internal configuration thereof together with the portion thereof which has a roughened textured surface.

FIG. 3 is an enlarged fragmentary vertical sectional view taken generally along the line 3—3 of FIG. 2 and shows generally the configuration of the textured surface.

FIG. 4 is a bottom plan view of the blow molded bottle of FIG. 1 and shows the roughened texture of the bottle base.

FIG. 5 is an enlarged fragmentary sectional view taken generally along the line 5—5 of FIG. 4 and shows the roughened texture of the outer surface of the bottle base.

Referring now to the drawings in detail, it will be seen that there is illustrated in FIG. 1 a modified blow mold generally identified by the numeral 10, in which there has been blow molded a plastic bottle or container in accordance with this invention, the bottle being generally identified by the numeral 12.

The blow mold 10 is generally formed in three pieces including longitudinally split sections 14, 16 and a base 18, the base 18 being movable relative to the sections 14, 16 in a longitudinal direction while the sections 14, 16 being moved in a transverse direction in the normal opening of the mold 10.

As is previously described, the bottle 12 is of the type specifically illustrated in U.S. Pat. No. 3,598,270 and includes a base or bottom generally identified by the numeral 20 as is best shown in FIG. 4. The bottle base 20 includes a plurality of generally hemispherical portions 22 which are disposed in circumferentially alternating relation with downwardly and radially outwardly projecting feet defining portions 24. These portions all merge into a central body portion 26.

Referring now to FIG. 2, it will be seen that the mold base 18 is constructed for the blow molding of the bottle base 20 and includes an upper cylindrical stepped portion 28 and is otherwise generally hollowed out to a hemispherical shape with there being upstanding portions 30 corresponding to the generally hemispherical portions 22 and recessed portions 32 for forming the feet defining portions 24. The portions 30 and 32 are disposed in circumferentially alternating relation.

It is to be understood that the mold base 18, as described, is conventional. It is also to be understood that the mold 10 may be formed of a soft metal such as aluminum.

In accordance with this invention, the lower central portion of the bottle defining surface of the mold base 18 is shot peened to define a roughened surface or a rough textured surface identified by the numeral 34. As is best illustrated in FIG. 3, while the remainder of the molding surface 36 of the mold base 18 is generally smooth, the shot peened portion has the rough textured surface 34 thereof generally in recessed relation with respect to the smooth surface.

As a result of the restricted shot peening of the molding surface of the mold base 18 in the area designated by the numeral 34, when the bottle 12 is blow molded within the blow mold 10 in a customary manner, the base 20 of the bottle 12 is provided in the lower central portion thereof with a rough textured surface 38 which is complementary to the rough textured surface 34 of the mold base 18. Thus, as is exaggerated in FIG. 5, while an upper portion of the bottle base 20 has a smooth exterior surface 40, the lower central portion of the body base 20 includes the rough textured surface 38, the rough textured surface being a projecting surface as opposed to the recessed rough textured surface 34 of the mold base 18.

Although only the lower central portion of the mold base 18 has been shot peened, it is to be understood that if one so desires, one could shot peen the overall molding surface of the mold base 18.

The rough textured surface 38 is in that area where cracking normally initiates and in effect eliminates the existence of a high stress area, such as by a minor crack in the exterior surface of the bottle base or other crack forming deficiencies.

Bottles in accordance with this invention have been blow molded utilizing an aluminum mold base which has the molding surface thereof shot peened and the resultant bottles were tested in comparison with like bottles formed from identical molds but not shot peened using a controlled environmental stress crack test. The bottles with the roughened surfaces outperformed the existing smooth surfaced configuration.

It is to be understood that the rough textured surface 38 is not to be compared with a very minor roughness as is utilized in certain instances to make a transparent plastic bottle opaque.

Although only a preferred embodiment of the bottle reinforcement has been specifically illustrated and described, it is to be understood that minor variations may be made therein without departing from the spirit and scope of the invention as defined by the appended claims.

We claim:

1. A blow molded plastic container for packaging products under pressure, said container having a base including generally hemispherical portions disposed in circumferential alternating relation with projecting feet defining portions, said base having a roughened external surface defining means for effecting dispersal of surface energy due to internal pressures.

2. A container according to claim 1 wherein said roughened external surface is a molded surface.

3. A container according to claim 1 wherein said roughened external surface is restricted to a lower central portion of said base.

4. A container according to claim 1 wherein said roughened external surface is free of external flaws.

5. A container according to claim 1 wherein said roughened external surface is complemental to a shot peened surface.

6. A container according to claim 3 wherein said roughened external surface is complemental to a shot peened surface.

7. A container according to claim 3 wherein said roughened external surface is a molded surface.

8. A container according to claim 3 wherein said roughened external surface is a molded surface complemental to a shot peened molding surface.

9. A container according to claim 3 wherein said roughened external surface is free of external flaws.

10. A container according to claim 1 wherein said roughened external surface is a molded surface complemental to a shot peened molding surface.

* * * * *